US010030912B2

(12) United States Patent
Yanik et al.

(10) Patent No.: US 10,030,912 B2
(45) Date of Patent: Jul. 24, 2018

(54) HEAT EXCHANGER AND MANUFACTURING METHOD THEREFOR, HEAT EXCHANGE MODULE, HEAT EXCHANGE DEVICE, AND HEAT SOURCE UNIT

(71) Applicant: Danfoss Micro Channel Heat Exchanger (Jiaxing) Co., Ltd., Zhejiang (CN)

(72) Inventors: Mustafa K. Yanik, Zhejiang (CN); Yang Xu, Zhejiang (CN); Jing Yang, Zhejiang (CN)

(73) Assignee: Danfoss Micro Channel Heat Exchanger (Jiaxing) Co., Ltd., Haiyan, Zhejian (CN)

( * ) Notice: Subject to any disclaimer, the term of this patent is extended or adjusted under 35 U.S.C. 154(b) by 42 days.

(21) Appl. No.: 15/124,276

(22) PCT Filed: Apr. 16, 2015

(86) PCT No.: PCT/CN2015/076759
§ 371 (c)(1),
(2) Date: Dec. 30, 2016

(87) PCT Pub. No.: WO2015/158280
PCT Pub. Date: Oct. 22, 2015

(65) Prior Publication Data

US 2017/0108278 A1 Apr. 20, 2017

(30) Foreign Application Priority Data

Apr. 18, 2014 (CN) ..... 2014 1 0158321

(51) Int. Cl.
*F28D 9/02* (2006.01)
*F28D 1/04* (2006.01)
(Continued)

(52) U.S. Cl.
CPC ..... *F28D 1/0443* (2013.01); *F28D 1/024* (2013.01); *F28D 1/0471* (2013.01); *F28D 2001/0273* (2013.01)

(58) Field of Classification Search
CPC ..... F28D 1/0443; F28D 1/024; F28D 1/0471; F28D 2001/0273; F24F 1/18; F24F 1/02;
(Continued)

(56) References Cited

U.S. PATENT DOCUMENTS

2012/0227944 A1 9/2012 Moisidis et al.
2012/0227945 A1 9/2012 Taras et al.
(Continued)

FOREIGN PATENT DOCUMENTS

CN 102472536 A 5/2012
CN 102483313 A 5/2012
(Continued)

OTHER PUBLICATIONS

Supplementary Partial European Search Report for Serial No. EP 15 77 9348 dated Jan. 22, 2018.
(Continued)

*Primary Examiner* — Davis Hwu
(74) *Attorney, Agent, or Firm* — McCormick, Paulding & Huber LLP

(57) ABSTRACT

A heat exchanger (10) of a heat exchange device used for air cooling cold water units or commercial roof machines, a method for manufacturing the heat exchanger (10), a heat exchange module, a heat exchange device, and a heat source unit. The heat exchanger (10) comprises: a main body portion (ab); a bent portion (cd) with a trapezoid cross section, the bent portion (cd) and the main body portion (ab) being connected and approximately perpendicular to each other; two collecting pipes (11, 12), disposed on two opposite sides of the heat exchanger (10); and multiple heat
(Continued)

exchange pipes (13), each extending from one collecting pipe (11) of the two collecting pipes (11, 12) to the other collecting pipe (12) by passing through the main body portion (ab) and the bent portion (cd), wherein a top edge of the bent portion (cd) and a top edge of the main body portion (ab) of the heat exchanger (10) are approximately located at the same height level.

20 Claims, 11 Drawing Sheets

(51) Int. Cl.
*F28D 1/047* (2006.01)
*F28D 1/02* (2006.01)

(58) Field of Classification Search
CPC ..... F24F 1/22; F24F 9/0243; F24F 2221/16; F24F 1/128
USPC ..... 165/175
See application file for complete search history.

(56) References Cited

U.S. PATENT DOCUMENTS

| | | | | |
|---|---|---|---|---|
| 2013/0240187 | A1* | 9/2013 | Hamaguchi | F24F 1/18 165/150 |
| 2013/0299153 | A1* | 11/2013 | Jindou | F28F 1/128 165/181 |
| 2013/0333409 | A1 | 12/2013 | Tanno et al. | |

FOREIGN PATENT DOCUMENTS

| | | | |
|---|---|---|---|
| CN | 103759553 | A | 4/2014 |
| CN | 103925742 | A | 7/2014 |
| EP | 1832833 | A2 | 9/2007 |
| EP | 2461111 | A1 | 6/2012 |
| JP | 2004340504 | A | 12/2004 |
| WO | 2011013672 | A1 | 2/2011 |

OTHER PUBLICATIONS

International Search Report for PCT Serial No. PCT/CN2015/076759 dated Jul. 2, 2015.

* cited by examiner

HEAT EXCHANGER AND MANUFACTURING METHOD THEREFOR, HEAT EXCHANGE MODULE, HEAT EXCHANGE DEVICE, AND HEAT SOURCE UNIT

CROSS REFERENCE TO RELATED APPLICATION

This application is entitled to the benefit of and incorporates by reference subject matter disclosed in the International Patent Application No. PCT/CN2015/076759 filed on Apr. 16, 2015 and Chinese Patent Application 201410158321.4 filed Apr. 18, 2014.

TECHNICAL FIELD

The present invention relates to the field of heating, ventilation and air conditioning, in particular to a heat exchanger and manufacturing method therefor, heat exchange module, heat exchange device and heat source unit for use in the technical field of commercial air conditioning.

BACKGROUND ART

The prior art document WO2011013672 has disclosed a heat source unit. Specifically, the heat source unit is provided with air heat exchangers, each air heat exchanger comprising multiple heat-dissipating fins arranged at regular intervals, heat exchange tubes passing through the heat-dissipating fins, bent plate parts which extend at two sides and are bent in the same direction, and a heat exchange module. Each heat exchange module comprises two air heat exchangers, each air heat exchanger having a bent part disposed opposite a bent part of another air heat exchanger. The air heat exchanger is inclined, such that bottom edges are close to each other but top edges are spaced apart; thus the heat exchange module is substantially V-shaped in a side view drawing.

However, edges of heat exchangers at left and right sides in the abovementioned heat source unit are spaced apart in an upper part of the V-shaped structure. Thus, a shrouding plate (or metal plate) is still needed to connect two heat exchangers, and as a result, the space between two heat exchangers is not effectively used.

Ever higher requirements are being placed on the energy efficiency of heating, ventilation and air conditioning systems (HVAC systems), so there is an ever increasing need for heat exchangers of higher performance. At present, the only option in the prior art is to manufacture larger heat exchangers and air conditioning systems, and this increases the costs of manufacture and installation.

In view of the above, there is definitely a need to provide a novel heat exchanger and manufacturing method therefor, heat exchange module, heat exchange device and heat source unit which are capable of at least partially solving the above problem.

SUMMARY

The object of the present invention is to resolve at least one aspect of the abovementioned problems and shortcomings in the prior art.

In one aspect of the present invention, a heat exchanger for a heat exchange device on an air-cooled water chiller unit or commercial rooftop machine is provided, the heat exchanger comprising:

a main body part;

a bending part having a substantially trapezoidal cross section, the bending part and the main body part being connected to each other and substantially lying in the same plane;

at least one heat exchange tube extending between the main body part and the bending part, with heat exchange tubes in the bending part being bent or inclined relative to heat exchange tubes in the main body part.

Preferably, the heat exchange tube is wound so as to extend continuously in a winding manner partially or completely between the main body part and the bending part.

Preferably, the heat exchanger also comprises two manifolds disposed on two opposite sides of the heat exchanger, wherein there are multiple heat exchange tubes, each of the heat exchange tubes extending from one of the two manifolds to the other manifold through the main body part and the bending part.

Preferably, the bending part is used to form a substantially trapezoidal side of the heat exchange device, top and bottom bases of the trapezoidal cross section are substantially parallel to a top edge and a bottom edge of the trapezoidal side, one or two sides of the heat exchange tubes is/are bent at an angle $\alpha$ using a width direction as an axis, wherein bending points of the heat exchange tubes are substantially on a bending straight line, and the angle $\alpha$ is in the range of $\theta/2-5°$ to $\theta/2+5°$, wherein $\theta$ is the included angle between two non-parallel edges of the trapezoidal side.

Preferably, when the trapezoidal side is formed by one bending part with a trapezoidal cross section, an included angle $\beta$ between the manifold on the trapezoidal cross section and the bending straight line is substantially equal to the included angle $\theta$, and the angle $\alpha$ is equal to half of the included angle $\theta$;

when the trapezoidal side is formed by symmetrically connecting two bending parts with trapezoidal cross sections, an included angle $\beta$ between the manifold on the trapezoidal cross section and the bending straight line is substantially equal to half of the included angle $\theta$, and the angle $\alpha$ is equal to half of the included angle $\theta$.

In another aspect of the present invention, a heat exchanger for a heat exchange device on an air-cooled water chiller unit or commercial rooftop machine is provided, the heat exchanger comprising:

a main body part;

a bending part having a trapezoidal cross section, the bending part and the main body part being connected to each other and substantially perpendicular;

at least one heat exchange tube extending between the main body part and the bending part, wherein a top edge of the bending part and a top edge of the main body part of the heat exchanger are at substantially the same height level.

Preferably, the heat exchange tube is wound so as to extend continuously in a winding manner partially or completely between the main body part and the bending part.

Preferably, the heat exchanger comprises two manifolds disposed on two opposite sides of the heat exchanger, wherein the at least one heat exchange tube comprises multiple heat exchange tubes, each of the heat exchange tubes extending from one of the two manifolds to the other manifold through the main body part and the bending part.

Preferably, the heat exchange tubes are disposed at intervals in the main body part and the bending part, and extend, substantially parallel to each other, in the main body part and the bending part.

Preferably, the heat exchange tubes are flat tubes and are fitted onto the manifolds by means of slots on the manifolds, the flat tubes extend between the manifolds on two sides of the heat exchanger, and preferably, fins are provided on the flat tubes.

Preferably, the heat exchanger is formed by the following steps:

first of all, one or two sides of each flat tube is bent at an angle $\alpha$ using a width direction as an axis, the bent flat tubes are inserted sequentially into the slots in the manifolds, wherein bending points of the flat tubes are substantially on a bending straight line;

the bent flat tubes are then bent further along the bending straight line, such that the main body part is perpendicular or substantially perpendicular to the bending part;

wherein the bending part is used to form a substantially trapezoidal side of the heat exchange device, top and bottom bases of the trapezoidal cross section are substantially parallel to a top edge and a bottom edge of the trapezoidal side, and the angle $\alpha$ is in the range of $\theta/2-5°$ to $\theta/2+5°$, wherein $\theta$ is the included angle between two non-parallel edges of the trapezoidal side.

Preferably, when the trapezoidal side is formed by one bending part with a trapezoidal cross section, an included angle $\beta$ between the manifold on the trapezoidal cross section and the bending straight line is substantially equal to the included angle $\theta$, and the angle $\alpha$ is equal to half of the included angle $\theta$;

when the trapezoidal side is formed by symmetrically connecting two bending parts with trapezoidal cross sections, an included angle $\beta$ between the manifold on the trapezoidal cross section and the bending straight line is substantially equal to half of the included angle $\theta$, and the angle $\alpha$ is equal to half of the included angle $\theta$.

Preferably, when a bending part is provided at only one side of the main body part, the spacing between flat tubes in the bending part is L, the flat tube at the bottommost edge in the bending part is shortest, the flat tube at the topmost end is longest, and the lengths of the flat tubes preferably increase incrementally by $2L\mathrm{tg}\alpha$ from bottom to top.

Preferably, when a bending part is provided on each of two sides of the main body part, the spacing between flat tubes in the bending part is L, the flat tube at the bottommost edge in the bending part is shortest, the flat tube at the topmost end is longest, and the lengths of the flat tubes preferably increase incrementally by $2L\mathrm{tg}\alpha$ or $4L\mathrm{tg}\alpha$ from bottom to top.

Preferably, substantially no fins are provided on the heat exchange tubes at the bending points between the main body part and the bending part; preferably, an end of each heat exchange tube in the bending part is bent, such that the heat exchange tube is inserted into the slot in the manifold perpendicularly or substantially perpendicularly; preferably, the main body part of the heat exchanger is substantially rectangular, square, trapezoidal or parallelogram-shaped.

In another aspect of the present invention, a heat exchange module for a heat exchange device on an air-cooled water chiller unit or commercial rooftop machine is provided, the heat exchange device comprising at least one heat exchange module, the at least one heat exchange module having at least one trapezoidal side;

the trapezoidal side is a heat exchange side, one of the heat exchange modules is formed by fitting together two heat exchange units on left and right sides, wherein at least one heat exchange unit is a heat exchanger as described above or a heat exchanger formed by bending the heat exchanger as described above.

Preferably, the heat exchange module comprises two heat exchange units, the two heat exchange units being substantially identical or symmetric, and the heat exchange unit being a heat exchanger having a bending part with a trapezoidal cross section on one side only.

Preferably, the heat exchange module comprises two heat exchange units, one of the two heat exchange units being a heat exchanger having a main body part only, and the other heat exchange unit being a heat exchanger having a bending part with a trapezoidal cross section on two sides.

In another aspect of the present invention, a heat exchange device on an air-cooled water chiller unit or commercial rooftop machine is provided, the heat exchange device comprising at least one heat exchange module, the at least one heat exchange module having at least one substantially trapezoidal side;

the trapezoidal side is a heat exchange side, and comprises a manifold and multiple heat exchange tubes disposed on the manifold.

Preferably, one of the heat exchange modules is formed by fitting together two heat exchange units on left and right sides, wherein the trapezoidal side is formed by bending at least one of the two heat exchange units on the left and right sides; or one of the heat exchange modules is formed by a single heat exchange unit, wherein the trapezoidal side is formed by bending a part of the single heat exchange unit; or one of each of the heat exchange modules is formed by multiple heat exchange units, wherein the trapezoidal side is formed by a single heat exchange unit, the trapezoidal side being fitted onto the heat exchange module, or one of the heat exchange modules comprises one heat exchange unit and one supporting member which are fitted together facing each other, with the heat exchange unit being bent to form the trapezoidal side, and the trapezoidal side being fitted onto the supporting member.

Preferably, each heat exchange unit is a single heat exchanger, the heat exchanger comprising two manifolds and multiple heat exchange tubes arranged at intervals between the manifolds, with fins preferably disposed on the heat exchange tubes.

Preferably, the trapezoidal side is formed by bending at least one of two heat exchange units on left and right sides, wherein at least one of the heat exchange units is the heat exchanger described above.

In another aspect of the present invention, a method for manufacturing the heat exchanger described above is provided, the heat exchanger being formed by the following steps:

first of all, one or two sides of each flat tube is bent using a width direction as an axis, the bent flat tubes are inserted sequentially into the slots in the two manifolds, wherein bending points of the flat tubes are substantially on a bending straight line;

the bent flat tubes are then bent further along the bending straight line using the bending straight line as an axis, such that the main body part is perpendicular or substantially perpendicular to the bending part with the trapezoidal cross section.

Preferably, one or two sides of each flat tube is bent at an angle $\alpha$ using a width direction as an axis, wherein the bending part is used to form a substantially trapezoidal side of the heat exchange device, top and bottom bases of the trapezoidal cross section are substantially parallel to a top edge and a bottom edge of the trapezoidal side, and the angle $\alpha$ is in the range of $\theta/2-5°$ to $\theta/2+5°$, wherein $\theta$ is the included angle between two non-parallel edges of the trapezoidal side.

Preferably, when the trapezoidal side is formed by one bending part with a trapezoidal cross section, an included angle $\beta$ between the manifold on the trapezoidal cross section and the bending straight line is substantially equal to the included angle $\theta$, and the angle $\alpha$ is equal to half of the included angle $\theta$;

when the trapezoidal side is formed by symmetrically connecting two bending parts with trapezoidal cross sections, an included angle $\beta$ between the manifold on the trapezoidal cross section and the bending straight line is substantially equal to half of the included angle $\theta$, and the angle $\alpha$ is equal to half of the included angle $\theta$.

Preferably, an end of the flat tubes on the trapezoidal cross section of the heat exchanger is bent, such that the flat tube is inserted into the slot in the manifold perpendicularly or substantially perpendicularly.

In another aspect of the present invention, a heat source unit is provided, the heat source unit also comprising, in cooperation with each other, a heat exchange device, a blower, a water drainage plate in communication with the heat exchange device, and a machine room which houses cooling cycle constituent parts other than the heat exchange device; the heat exchange device is the heat exchange device as described above or a heat exchange device using the heat exchanger manufactured by the method described above.

The heat exchange device according to the present invention has no need of additional sheet metal to connect the left/right-side heat exchangers. At least one of the left/right-side heat exchangers is bent, and the left/right-side heat exchangers are connected to each other to increase the heat exchange area.

BRIEF DESCRIPTION OF THE DRAWINGS

These and/or other aspects and advantages of the present invention will become obvious and easy to understand through the following description of the preferred embodiments in conjunction with the accompanying drawings, wherein.

DETAILED DESCRIPTION

Figure 1:
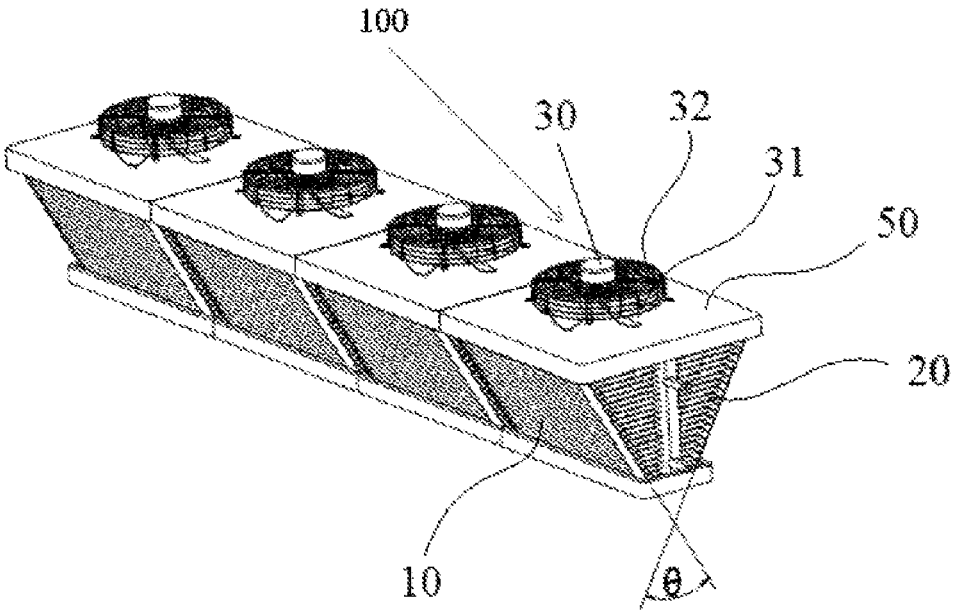
FIG. 1 is a schematic diagram of a heat exchange device according to the present invention.

The technical solution of the present invention is explained in further detail below by means of embodiments, in conjunction with FIGS. 1-11. In this description, identical or similar drawing labels indicate identical or similar components. The following explanation of the embodiments of the present invention with reference to the accompanying drawings is intended to explain the overall inventive concept of the present invention, and should not be interpreted as a limitation of the present invention.

As will be understood from the background art of the present invention, the key design point of the present invention lies in improvement of the heat exchange module used in the heat source unit in the document WO 2011013672. Specifically, since the pair of heat exchangers in that document are arranged in a substantially V-shaped form in a side view drawing, a substantially V-shaped space will be formed between bent parts of opposing air heat exchangers. Clearly, in the above document, the space between main body parts of the pair of heat exchangers that have been fitted together, and the space between their adjacent bent parts, both substantially form the same V-shape, in other words the included angles between them are the same, and are generally in the range of 30-90°. The final result is that the V-shaped space between the pair of heat exchangers is not used effectively. Since the included angle between them is large, the V-shaped space must be closed by a plate body that has been cut into a substantially V-shaped form, i.e. a shrouding plate, to prevent air or wind from passing through the V-shaped space and thereby affecting the heat exchange effect.

In the present invention, a heat exchanger and manufacturing method therefor, heat exchange module, heat exchange device and heat source unit are provided, which successfully resolve the shortcomings mentioned in the above document at least partially. Thus, the description below will focus on ways in which the present invention improves the heat exchanger and manufacturing method therefor, heat exchange module, heat exchange device and heat source unit. The arrangement of components in the heat source unit mentioned in the above document (such as a blower, a water drainage plate in communication with the heat exchange device, and a machine room which houses cooling cycle constituent parts other than the heat exchange device) may also be applied in the present invention, and therefore the aforesaid document may be referred to for a specific description of those components, which are not described in detail again here.

It is clear from the abovementioned document that a conventional heat exchanger is generally rectangular, and requires a sheet metal element to close the V-shaped side. It must be explained here that although it is referred to as a V-shaped side in the abovementioned document, in actual manufacturing processes it is generally manufactured to have a substantially trapezoidal shape, as can be seen from the accompanying drawings of the present invention and the abovementioned document. Therefore, in the present invention it is referred to as a trapezoidal side, so as to better conform to the actual situation. The object of the present invention is to increase the heat exchange area, to meet different application and installation requirements. It can be seen from the following that in the present invention, the heat exchanger is bent such that a side forms a trapezoidal or substantially trapezoidal shape, to replace the trapezoidal side closed by a sheet metal element.

The heat exchanger and manufacturing method therefor, heat exchange module, heat exchange device and heat source unit according to an embodiment of the present invention may be applied to a commercial air conditioning system, specifically used in a heat source unit, an air-cooled water chiller unit or a commercial rooftop machine. In general, the heat exchange device comprises at least one heat exchange module, having at least one side (abbreviated as trapezoidal side hereinbelow) with a substantially trapezoidal cross section perpendicular to left and right sides, wherein the trapezoidal side is a heat exchange side, i.e. a side formed by a manifold and heat exchange tubes and/or fins thereon. Hereinbelow, only a heat exchange unit on one side in one heat exchange module is shown for the sake of conciseness, i.e. the structure of one heat exchanger, as an example.

Referring to FIG. 1, a view of a heat exchange device using the heat exchange module according to the present invention is shown. In order to focus on describing the important points, the figure omits the related components in a water chiller unit or heat source unit associated therewith. In view of the fact that the main design of the present invention relates to the heat exchange device, such an omission will not affect the understanding of the present invention by those skilled in the art, and will not result in the disclosed content of the present invention being incomplete.

FIG. 1 shows a heat exchange device which has only four heat exchange modules. It can be understood that the heat exchange device according to the present invention may comprise one or more (e.g. two, three, five) heat exchange modules 100 and a corresponding number of blower modules or blower units, wherein the multiple blower modules or blower units form a blower apparatus or blower system. Of course, each blower unit or module may also be one blower or a greater number of blowers.

In one embodiment of the present invention, each heat exchange module 100 comprises a heat exchange unit 10 and a heat exchange unit 20. In the heat exchange module 100, the trapezoidal side is formed by at least one bending part in the heat exchange unit 10 and/or heat exchange unit 20. Of course, those skilled in the art will understand that the way in which the heat exchange module 100 is formed is not limited to the type described above; the heat exchange module 100 may also be formed in the following ways: the heat exchange module 100 may comprise a single heat exchange unit, with trapezoidal sides thereof being formed by bending a part of the single heat exchange unit (e.g. bending two ends of a single flat-plate heat exchanger). Alternatively, the heat exchange module 100 may also be formed by multiple heat exchange units, wherein a trapezoidal side is formed by a single heat exchange unit, the trapezoidal side being fitted onto another part (e.g. another heat exchanger adjacent thereto) of the heat exchange module. Alternatively, the heat exchange module 100 may also comprise one heat exchange unit and one supporting member (e.g. a metal plate supporting member) which are fitted together facing each other, with the heat exchange unit being bent to form the trapezoidal side, and the trapezoidal side being fitted onto the supporting member. In principle, each heat exchange unit is a single heat exchanger in the conventional sense, i.e. has two manifolds, and multiple heat exchange tubes (e.g. flat tubes, on which multiple fins may be disposed if possible) extending in parallel at intervals therebetween. Of course, multiple heat exchangers may also be included. To make the description concise, a single heat exchange unit is abbreviated as a heat exchanger below.

Those skilled in the art will understand that when the heat exchange device has multiple heat exchange modules 100, the heat exchange device may be formed of multiple heat exchange modules 100 of the same type, or employ any combination of the different types of heat exchange module 100 described above, as required.

Referring to FIG. 1, a top end of the heat exchange module 100 is provided with a top plate 50, and a blower module or unit 30 is provided on the top plate in a position corresponding to the heat exchangers 10 and 20. In one embodiment, a cylindrical wind outlet 31 is provided in a direction of upward protrusion from the top plate 50, and a fan shroud 32 covers a protruding end face of the wind outlet 31. The blower 30 comprises: a propeller-type fan, accommodated in the wind outlet 31; a shaft core, mounted in opposition to the fan shroud 32, and a fan motor, with the propeller-type fan being mounted on a rotation shaft.

Of course, in order to fix the heat exchange module 100 in place better, the bottom of the heat exchange module 100 may also be provided with a supporting element or supporting frame (not shown) which fixes it in place. In practice, as FIG. 1 shows, the left and right sides of the heat exchange module 100 are not V-shaped sides in a strict sense, but trapezoidal sides in practical applications. As shown in the figure, each heat exchange module 100 has, on both the left and the right side in the plane of the page, a trapezoidal side with an included angle θ between two non-parallel edges.

Figure 2:
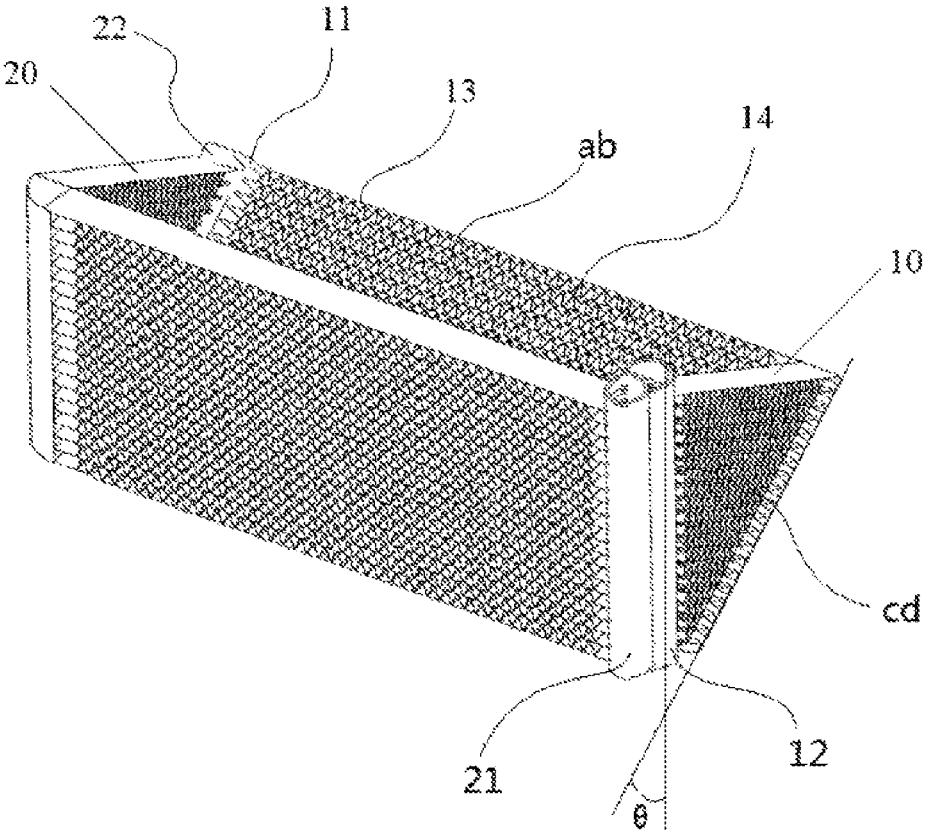
FIG. 2 is a schematic diagram of a heat exchange module according to a first embodiment of the present invention, excluding all parts other than the heat exchange unit or heat exchanger.

Reference is made to FIG. 2, which shows a heat exchange module 100 in a first embodiment of the present invention. For the sake of simplicity, only a heat exchange part or heat exchanger/heat exchange unit contained therein is shown here. The heat exchange module 100 comprises a heat exchange unit 10 and a heat exchange unit 20 which have been bent. In view of the fact that in the present invention the heat exchange unit 10 and the heat exchange unit 20 are each formed of a single heat exchanger, they are abbreviated as heat exchanger 10 or 20. Of course, the heat exchange units 10 and 20 may also be formed of two or more heat exchangers (which heat exchangers are known in the prior art, i.e. each heat exchanger has two manifolds as well as heat exchange tubes and fins disposed therebetween). Specifically referring to FIG. 3, the heat exchanger 10 comprises a manifold 11, a manifold 12, heat exchange tubes 13 and fins 14, which lie in substantially the same plane (for example in the plane of the page in FIG. 3). The multiple heat exchange tubes extending horizontally in a left-right direction in the plane of the page in FIG. 3 (and the fins, if provided) form a main body part ab of the heat exchanger 10, while multiple heat exchange tubes and fins disposed at an angle α relative to the left-right direction in the plane of the page in FIG. 3 form a bending part cd. The bending part cd has a substantially trapezoidal cross section, for forming a trapezoidal side of the heat exchange module (this will be described below). The main body part ab and bending part cd are connected at a straight line Y, which is called a bending straight line Y due to the fact that, as described below, the bending part cd will be bent outwards relative to the plane of the page in FIG. 3, using the bending straight line Y as an axis.

Figure 3:
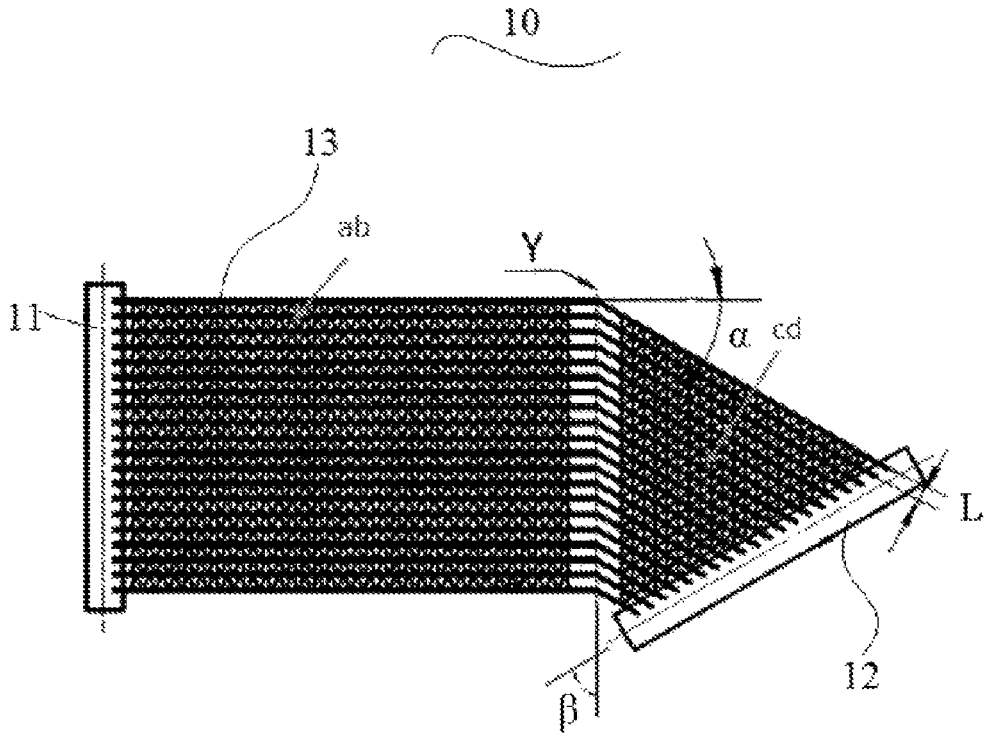
FIG. 3 is a schematic diagram of the heat exchanger in FIG. 2 after the flat tubes have been bent the first time.

In the heat exchanger 10 shown in FIG. 3, the manifolds 11 and 12 are respectively disposed at outermost sides of the heat exchanger 10, i.e. at the left side of the main body part ab and the right side of the bending part cd. The lengths of the manifold 11 and the manifold 12 are equal or approximately equal, but as shown in the figure, they form a certain angle or are inclined relative to one another. Multiple heat exchange tubes 13 are disposed at intervals, parallel to each other, between the manifold 11 and the manifold 12. Multiple slots for fitting the heat exchange tubes 13 are provided on the manifolds 11 and 12 respectively. The fins 14 are disposed between adjacent heat exchange tubes 13. In this example, the heat exchange tubes 13 are flat tubes.

One or two sides of the heat exchange tubes 13 is/are bent at an angle $\alpha$ for example, using a width direction as an axis, wherein bending points of the heat exchange tubes are substantially on the bending straight line Y, the angle $\alpha$ is in the range of $\theta/2-5°$ to $\theta/2+5°$, wherein $\theta$ is the included angle of the trapezoidal cross section. It will be understood that when one side of the heat exchange tube 13 is bent as described above, a bending part with a trapezoidal cross section can only be formed at one side thereof. If it is necessary to form bending parts with trapezoidal cross sections at two sides of the heat exchanger, then two sides of the heat exchange tubes must each be bent as described above.

By the same principle, the heat exchanger 20 may be arranged in a similar manner to the heat exchanger 10, and is not described here.

Taking FIG. 3 as an example, the method of bending the heat exchanger 10 having a bending part at just one side is explained as follows: first the flat tubes 13 are bent, then a body of the heat exchanger 10 is bent. The specific bending steps are as follows: first of all, one side of each flat tube 13 (such as the right side of the flat tube in the drawing) is bent at an angle $\alpha$ using the width direction of the flat tube (i.e. the front-rear direction in the plane of the page) as an axis, and the bent flat tubes 13 are then inserted into the slots (not shown) in the manifolds 11 and 12 in sequence. Then by adjusting the positions of the flat tubes, it is ensured that the bending points of all the flat tubes 13 are substantially on one line, i.e. on the bending straight line Y shown in FIG. 3. Thus the heat exchanger 10 forms a main body part ab and a bending part cd. Fins are inserted between adjacent flat tubes, which are then put into a brazing furnace and brazed to form a single body. Finally, the bending part cd in the bent heat exchanger is bent along a direction substantially perpendicular to the main body part ab using the bending straight line Y as a bending straight line (i.e. the body of the heat exchanger is bent), such that the main body part ab and the bending part cd are perpendicular or substantially perpendicular (see FIG. 4).

Figure 4:
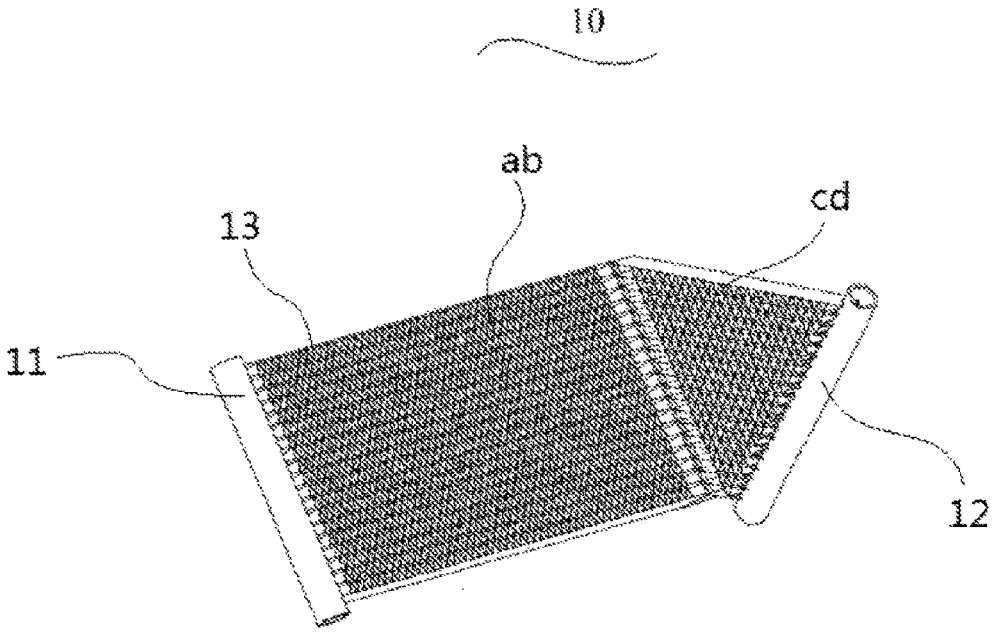
FIG. 4 is a schematic diagram of the heat exchanger in FIG. 2 after being bent the final time.

Referring to FIGS. 2 and 4, when the heat exchanger 10 is bent, the shape thereof becomes a three-dimensional structure having substantially six edges; the main body part ab is a rectangular side in the heat exchange module 100, while the bending part cd is a trapezoidal side in the heat exchange module 100. However, it can be understood that the case of the main body part ab being of rectangular shape is just one example; it may have any suitable shape as required, for example a substantially square, trapezoidal, or parallelogram shape.

In the bending part cd, the bottommost flat tube has the shortest length, the topmost flat tube has the longest length, and the spacing between flat tubes is L. Moreover, preferably, the lengths of the flat tubes in the bending part increase incrementally by $2L\mathrm{tg}\alpha$ from bottom to top. For convenience of processing, the length of each flat tube can be adjusted slightly.

During bending, preferably, the bending angle $\alpha$ of the flat tubes is substantially half of the included angle $\theta$ between two non-parallel edges of the trapezoidal side (i.e. the bending part cd), but generally only needs to be in the range of $\theta/2-5°$ to $\theta/2+5°$. The included angle $\beta$ between the bending straight line Y and the manifold 12 is preferably substantially equal to apex angle $\theta$. Of course, the manner of bending described above is merely an example of the present invention; those skilled in the art could of course choose another manner of bending as required (for example perform bending at a different angle).

Figure 5:
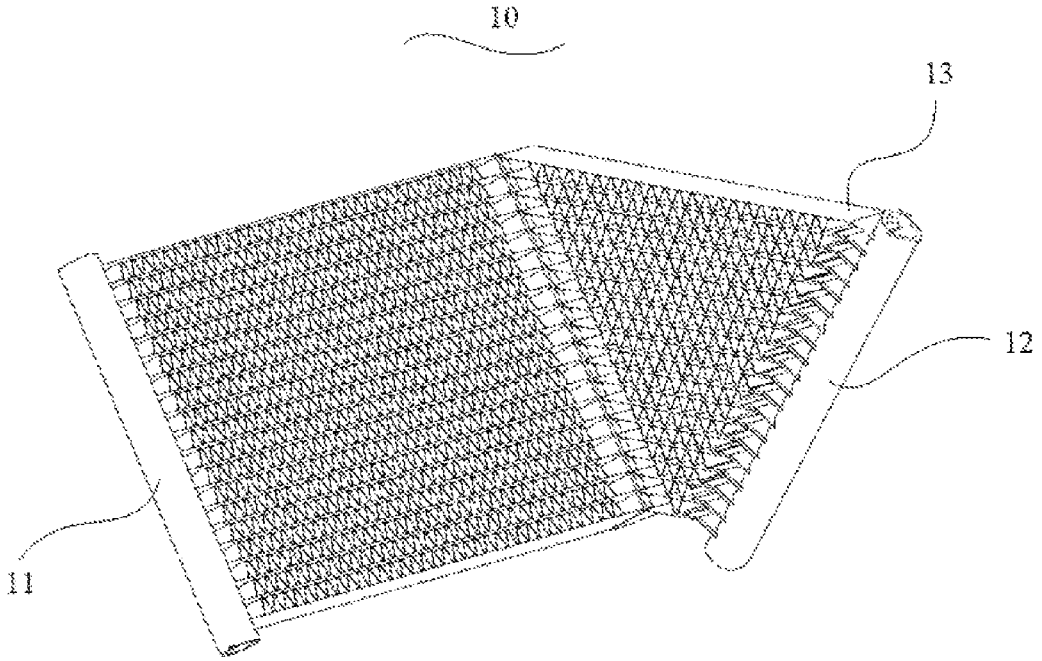
FIG. 5 is a structural schematic diagram of the flat tubes of the heat exchanger shown in FIG. 2, inserted perpendicularly into the manifold.

Referring to FIG. 5, for convenience of assembly, that end of the flat tube 13 which is located at the manifold 12 side may be bent so that the flat tube 13 is inserted into the slot in the manifold 12 perpendicularly or substantially perpendicularly. Of course, those skilled in the art may arrange for substantially or essentially no fins to be provided at the bending point of the flat tube 13 (i.e. substantially the location of the bending straight line Y), so that it is easier to bend the heat exchanger 10, and the bending radius can be made as small as possible.

Those skilled in the art will understand that in this embodiment, since the right-side heat exchanger 10 and left-side heat exchanger 20 in the heat exchange module 100 are substantially identical or symmetric, the structure and bending principles of the heat exchanger 20 are substantially the same as the structure and principles of the heat exchanger 10, so are not described again here.

Referring to FIG. 2 again, the heat exchanger 10 and heat exchanger 20 are connected to each other by means of their respective manifolds, to form the heat exchange module 100. That is, manifold 11 in the heat exchanger 10 is connected to manifold 22 in the heat exchanger 20, and manifold 12 in the heat exchanger 10 is connected to manifold 21 in the heat exchanger 20, such that the bending parts of the heat exchanger 10 and the heat exchanger 20 are used as two trapezoidal sides of the heat exchange module 100 respectively, so the heat exchange area is increased.

Of course, those skilled in the art will understand that the heat exchanger 20 may be a supporting member or a flat heat exchanger connected to the heat exchanger 10 in a fitted manner. That is, a flat heat exchanger or supporting member can be bent so as to be connected to the heat exchanger 10 in a fitted manner, to form the heat exchange module 100. Of course, the heat exchanger 10 may likewise be a supporting member or a flat heat exchanger connected to the heat exchanger 20 in a fitted manner; those skilled in the art may make a selection as required. The above examples are merely given to provide a demonstrative explanation, and cannot be interpreted as being a limitation of the present invention.

Figure 6:
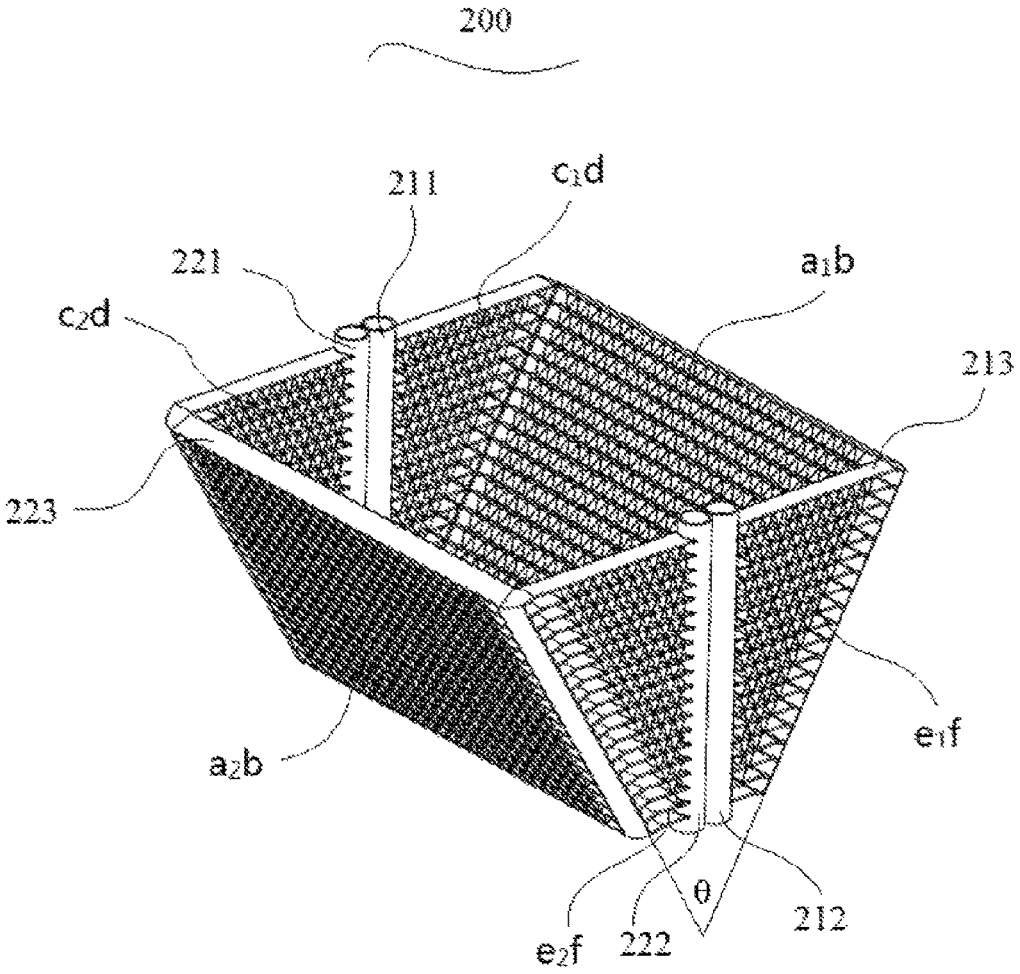
FIG. 6 is a schematic diagram of a heat exchange module according to a second embodiment of the present invention, excluding all parts other than the heat exchange unit or heat exchanger.

Reference is made to FIG. 6, which shows a heat exchange module 200 according to a second embodiment of the present invention. The heat exchange module 200 is a variation of the heat exchange module 100 shown in FIG. 2, thus the heat exchange module 200 has substantially the same structure and principles as the heat exchange module 100 shown in FIG. 2, with the difference being that the heat exchanger 210 in the heat exchange module 200 has two bending parts. The differences are described in detail below, but the identical features are not repeated here.

The heat exchange module 200 comprises a heat exchanger 210 on a right side and a heat exchanger 220 on a left side. The heat exchangers 210 and 220 each have two bending parts. The bending process is explained below using one of the heat exchangers 210 and 220 as an example. In this example, the heat exchange tubes are flat tubes.

Figure 7:
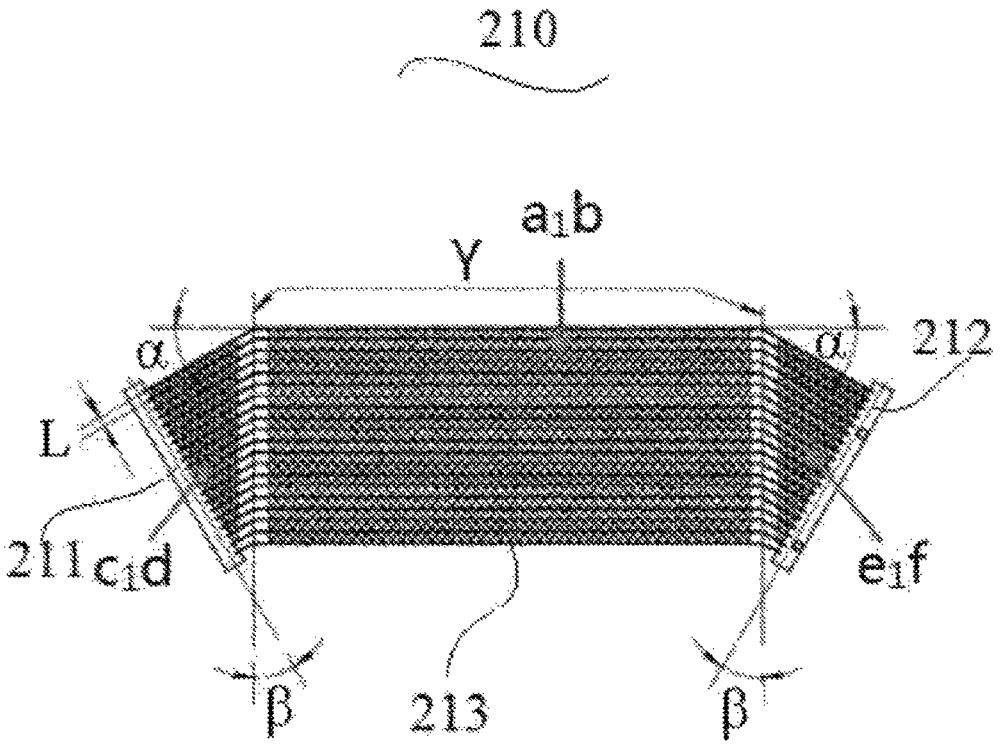
FIG. 7 is a schematic diagram of the heat exchanger in FIG. 6 after the flat tubes have been bent the first time.
Figure 8:
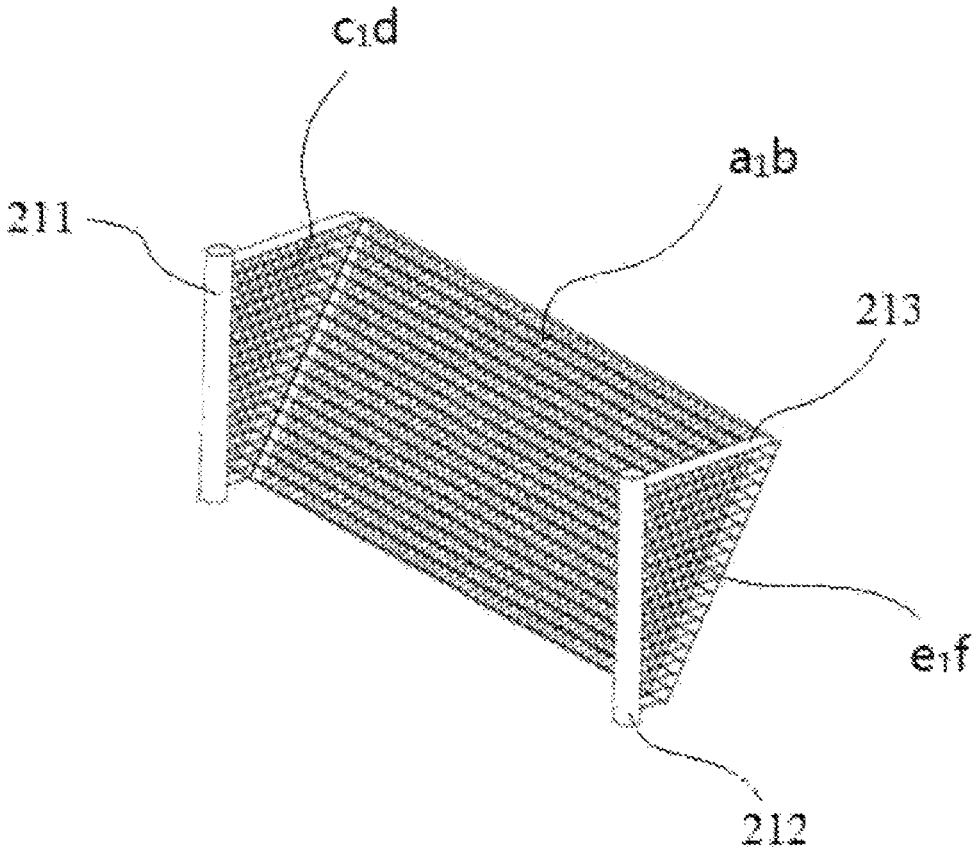
FIG. 8 is a schematic diagram of the heat exchanger in FIG. 6 after being bent the final time.

Referring to FIG. 7, the heat exchanger 210 is bent by the following steps: first of all, two sides of each flat tube 213 (i.e. the left and right sides of the flat tube in the plane of the page) are respectively bent at an angle (e.g. an angle α) using a width direction as an axis, and the multiple bent flat tubes 213 are sequentially inserted into slots in manifolds 211 and 212. Then by adjusting the positions of bending points of the flat tubes, it is ensured that the bending points of the multiple flat tubes 213 are substantially on one line, i.e. on the bending straight line Y shown in FIG. 7. Thus, the heat exchanger 210 forms a main body part $a_1b$, a bending part $c_1d$ and a bending part $e_1f$ (clearly, the main body part and the bending parts lie in substantially the same plane at this time, i.e. in the plane of the page in the figure). Finally, the left side of the flat tube 213 and the right side of the flat tube 213 are bent in a direction perpendicular to the main body part $a_1b$ along the bending straight lines Y at the two sides respectively (i.e. the body of the heat exchanger 210 is bent), such that the bending part $c_1d$ is substantially perpendicular to the main body part $a_1b$, and the bending part $e_1f$ is substantially perpendicular to the main body part $a_1b$ (as shown in FIG. 8).

Referring to FIG. 7, at this time, the manifolds 211 and 212 and the flat tubes 213 of the heat exchanger 210 lie in substantially the same plane (e.g. in the plane of the page in the figure), and the heat exchanger is an octagon having eight edges, with the main body part $a_1b$ being substantially rectangular, while the bending parts $c_1d$ and $e_1f$ are each substantially trapezoidal. In the bending parts $c_1d$ and $e_1f$, the flat tube at the bottommost edge has the shortest length, while the flat tube at the topmost end has the longest length. The spacing between flat tubes is L, and the lengths of the flat tubes increase incrementally by 2Ltgα from bottom to top. For convenience of processing, the length of each flat tube can be adjusted slightly.

During bending, preferably, the bending angle α of the flat tubes is substantially half of the included angle θ (see FIG. 6) between two non-parallel edges of the trapezoidal side in the heat exchange module 200. The included angle β formed between each bending straight line Y and the manifolds 212 and 213 respectively is preferably such that the bending angle α is substantially equal to the included angle β and substantially equal to half of the included angle θ.

Those skilled in the art will understand that in this embodiment, since the right-side heat exchanger 210 and left-side heat exchanger 220 in the heat exchange module 200 are substantially identical or symmetric, the structure and bending principles of the heat exchanger 220 are substantially the same as the structure and bending principles of the heat exchanger 210, so are not described again here.

Referring again to FIG. 6, the heat exchanger 220 comprises manifolds 221 and 222 and multiple flat tubes 223. After being bent, the heat exchanger 220 forms a main body part $a_2b$, a bending part $c_2d$ and a bending part $e_2f$.

The heat exchanger 210 and heat exchanger 220 are connected to each other by means of their respective manifolds, to form the heat exchange module 200. That is, the manifold 211 in the heat exchanger 210 is connected to the manifold 221 in the heat exchanger 220, and the manifold 212 in the heat exchanger 210 is connected to the manifold 222 in the heat exchanger 220, so that the main body part $a_1b$ of the heat exchanger 210 and the main body part $a_2b$ of the heat exchanger 220 form a front part and a rear part, respectively, of the heat exchange module 200 in the plane of the page. The bending part $c_1d$ of the heat exchanger 210 and the bending part $c_2d$ of the heat exchanger 220 form a trapezoidal side on the left side of the heat exchange module 200 in the plane of the page, through the connection of the manifolds 211 and 221 (i.e. the two bending parts are connected symmetrically with respect to each other to form the trapezoidal side). The bending part $e_1f$ of the heat exchanger 210 and the bending part $e_2f$ of the heat exchanger 220 form a trapezoidal side on the right side of the heat exchange module 200 in the plane of the page, through the connection of the manifolds 212 and 222 (i.e. the two bending parts are connected symmetrically with respect to each other to form the trapezoidal side).

Of course, those skilled in the art will understand that the heat exchanger 220 may be a supporting member or a flat heat exchanger connected to the heat exchanger 210 in a fitted manner. That is, a flat heat exchanger or supporting member can be bent so as to be connected to the heat exchanger 210 in a fitted manner, to form the heat exchange module 200. Of course, a flat heat exchanger or supporting member could also be connected to the manifolds 211 and 212 of the heat exchanger 210 directly, to form the heat exchange module 200. Of course, the heat exchanger 210 may likewise be a supporting member or a flat heat exchanger connected to the heat exchanger 220 in a fitted manner; those skilled in the art may make a selection as required. The above examples are merely given to provide a demonstrative explanation, and cannot be interpreted as being a limitation of the present invention.

Figure 9:
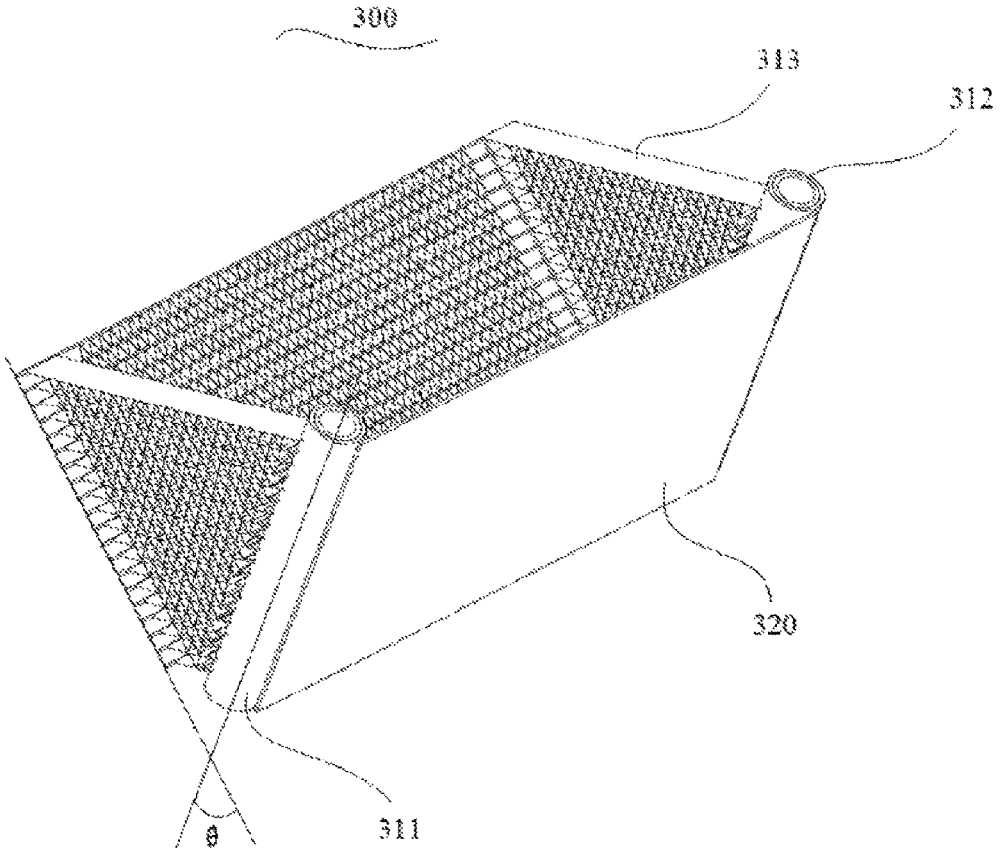
FIG. 9 is a schematic diagram of a heat exchange module according to a third embodiment of the present invention, excluding all parts other than the heat exchange unit or heat exchanger.

Referring to FIG. 9, a heat exchange module 300 according to a third embodiment of the present invention is shown. The heat exchange module 300 is a variation of the heat exchange module 200 shown in FIG. 6, therefore the structure and principles of the heat exchange module 300 are substantially the same as the structure and principles of the heat exchange module 200 shown in FIG. 6, the difference being that a heat exchanger 310 on the left side of the heat exchange module 300 is bent, whereas a heat exchanger 320 on the right side of the heat exchange module 300 is a flat heat exchanger which is not bent. The differences are described in detail below, but the identical features are not repeated here.

The heat exchange module 300 comprises the heat exchanger 310 on the left side and the heat exchanger 320 on the right side. Two outermost edges of the heat exchanger 320 are provided with manifolds 311 and 312 respectively, with multiple heat exchange tubes 313 being disposed, parallel to each other, between the manifold 311 and the manifold 312; in this example, the heat exchange tubes are flat tubes.

The step of bending the heat exchanger 310 is the same as the step of bending the heat exchanger 210 shown in FIG. 6, so is not repeated here.

Figure 11:
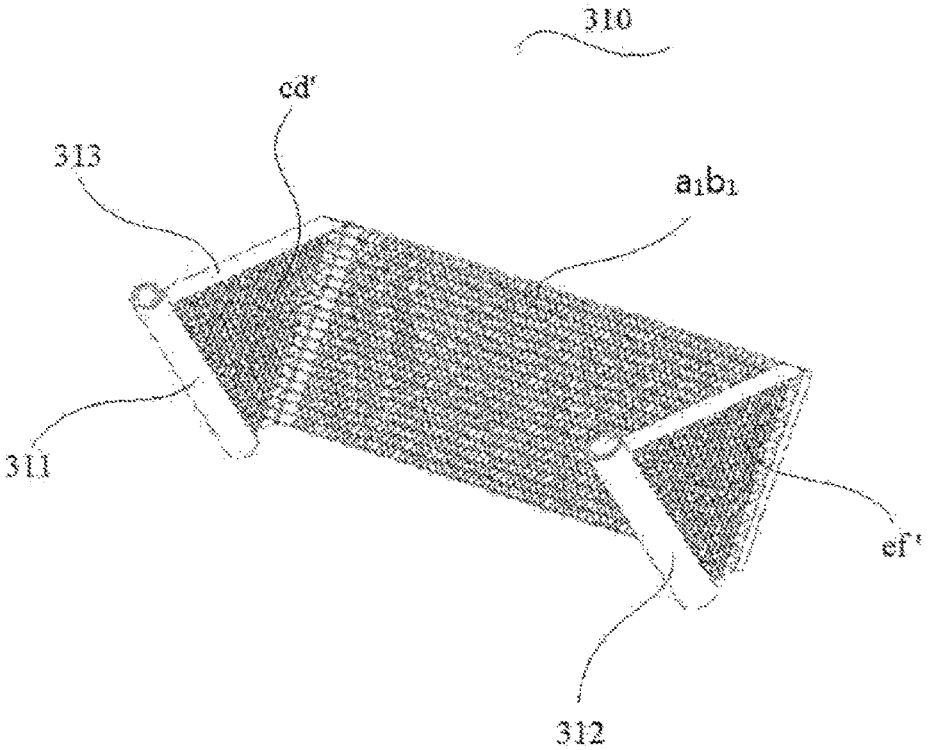
FIG. 11 is a schematic diagram of the heat exchanger in FIG. 9 after being bent the final time.

Referring to FIG. 11, after the heat exchanger 310 has been bent, the shape thereof is a three-dimensional structure with eight edges; a main body part $a_1b_1$ thereof is substantially rectangular, and forms a rear part of the heat exchange module 300 shown in FIG. 9. Bending parts cd' and ef' are each perpendicular to the main body part $a_1b_1$ and form trapezoidal sides on the left and right sides of the heat exchange module 300 shown in FIG. 9, thereby increasing the heat exchange area of the heat exchange module.

Figure 10:
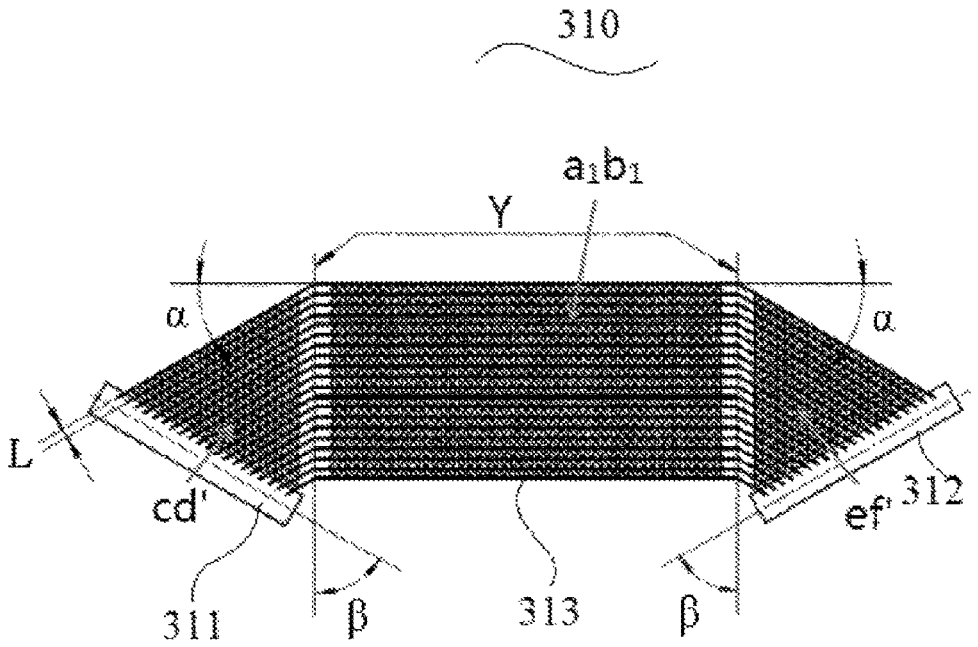
FIG. 10 is a schematic diagram of the heat exchanger in FIG. 9 after the flat tubes have been bent the first time.

Specifically, referring to FIG. 10, in the bending parts cd' and ef', the flat tube at the bottommost edge has the shortest length, while the flat tube at the topmost end has the longest length. Preferably, the spacing between flat tubes is L, and the lengths of the flat tubes increase incrementally by 4Ltgα from bottom to top. For convenience of processing, the length of each flat tube can be adjusted slightly.

During bending, preferably, the bending angle α of the flat tubes is substantially half of the included angle θ of the trapezoidal side in the heat exchange module 300. The included angle between each bending straight line Y and the manifolds 312 and 313 respectively is β, and preferably the bending angle α is substantially equal to half of the included angle β.

Those skilled in the art will understand that in this embodiment, since the right-side heat exchanger 320 in the heat exchange module 300 is a flat heat exchanger, the heat exchanger 320 is connected to the heat exchanger 310 by means of the manifolds 311 and 312, to form the heat exchange module 300, with a flat side of the heat exchanger 320 forming a front part of the heat exchange module 300 shown in FIG. 9.

Of course, those skilled in the art will understand that the heat exchanger 320 may be an ordinary rectangular heat exchanger or supporting member (e.g. a metal plate) connected to the heat exchanger 310 in a fitted manner.

In each of the abovementioned three embodiments of the present invention, first of all the flat tubes are bent at an angle of a for example, then the bent flat tubes are bent relative to the main body part of the heat exchanger so as to be perpendicular to the main body part, thereby finally forming the trapezoidal sides of the heat exchange device; however, it is also possible to manufacture a heat exchanger with a similar structure in a different way. For example, a structure which is identical or similar to that of the heat exchanger of the present invention is obtained by winding the heat exchange tubes so that they continuously extend in a winding manner partially or completely between the main body part and the bending parts of the abovementioned heat exchanger. In other words, a heat exchanger similar to the present invention can be obtained by winding one or more heat exchange tubes to form a substantially U-shaped or winding structure. In feasible circumstances, such a winding method can eliminate the need for manifolds.

The advantage of the present invention is that it can increase the heat exchange area of the heat exchange device without increasing the size of the HVAC system. It can increase the energy efficiency of the HVAC system (decrease the consumed power) by increasing the heat exchange performance of the heat exchanger. If the HVAC does not require higher energy efficiency and greater heat exchange performance, the present invention can also be used to reduce the number of heat exchangers in the system, such that the entire HVAC system is more compact, and has lower manufacturing and installation costs.

The above are merely some embodiments of the present invention. Those skilled in the art will understand that changes may be made to these embodiments without departing from the principles and spirit of the overall inventive concept. The scope of the present invention is defined by the claims and their equivalents.

What is claimed is:

1. A heat exchanger for a heat exchange device on an air-cooled water chiller unit or commercial rooftop machine, the heat exchanger comprising:

a main body part;

a bending part having a substantially trapezoidal cross section, the bending part and the main body part being connected to each other and substantially lying in the same plane;

at least one heat exchange tube extending between the main body part and the bending part, with heat exchange tubes in the bending part being bent or inclined relative to heat exchange tubes in the main body part.

2. The heat exchanger as claimed in claim 1, wherein:

the heat exchange tube is wound so as to extend continuously in a winding manner partially or completely between the main body part and the bending part.

3. The heat exchanger as claimed in claim 1, wherein:

also comprising two manifolds disposed on two opposite sides of the heat exchanger, wherein there are multiple heat exchange tubes, each of the heat exchange tubes extending from one of the two manifolds to the other manifold through the main body part and the bending part.

4. The heat exchanger as claimed in claim 3, wherein:

the bending part is used to form a substantially trapezoidal side of the heat exchange device, top and bottom bases of the trapezoidal cross section are substantially parallel to a top edge and a bottom edge of the trapezoidal side, one or two sides of the heat exchange tubes is/are bent at an angle α using a width direction as an axis, wherein bending points of the heat exchange tubes are substantially on a bending straight line, and the angle α is preferably in the range of θ/2−5° to θ/2+5°, wherein θ is the included angle between two non-parallel edges of the trapezoidal side.

5. The heat exchanger as claimed in claim 4, wherein:

when the trapezoidal side is formed by one bending part with a trapezoidal cross section, an included angle β between the manifold on the trapezoidal cross section and the bending straight line is substantially equal to the included angle θ, and the angle α is preferably substantially equal to half of the included angle θ;

when the trapezoidal side is formed by symmetrically connecting two bending parts with trapezoidal cross sections, an included angle β between the manifold on the trapezoidal cross section and the bending straight line is substantially equal to half of the included angle θ, and the angle α is preferably substantially equal to half of the included angle θ.

6. The heat exchanger as claimed in claim 3, wherein:

the heat exchange tubes are disposed at intervals in the main body part and the bending part, and extend, substantially parallel to each other, in the main body part and the bending part.

7. The heat exchanger as claimed in claim 6, wherein:

the heat exchange tubes are flat tubes and are fitted onto the manifolds by means of slots on the manifolds, the flat tubes extend between the manifolds on two sides of the heat exchanger, and preferably, fins are provided on the flat tubes.

8. The heat exchanger as claimed in claim 7, wherein:

the heat exchanger is formed by the following steps:

first of all, one or two sides of each flat tube is bent at an angle α using a width direction as an axis, the bent flat tubes are inserted sequentially into the slots in the manifolds, wherein bending points of the flat tubes are substantially on a bending straight line;

the bent flat tubes are then bent further along the bending straight line, such that the main body part is perpendicular or substantially perpendicular to the bending part;

wherein the bending part is used to form a substantially trapezoidal side of the heat exchange device, top and bottom bases of the trapezoidal cross section are substantially parallel to a top edge and a bottom edge of the trapezoidal side, and the angle α is in the range of θ/2−5° to θ/2+5°, wherein θ is the included angle between two non-parallel edges of the trapezoidal side.

9. The heat exchanger as claimed in claim 8, wherein:

when the trapezoidal side is formed by one bending part with a trapezoidal cross section, an included angle β between the manifold on the trapezoidal cross section and the bending straight line is substantially equal to the included angle θ, and the angle α is preferably substantially equal to half of the included angle θ;

when the trapezoidal side is formed by symmetrically connecting two bending parts with trapezoidal cross sections, an included angle β between the manifold on the trapezoidal cross section and the bending straight line is substantially equal to half of the included angle θ, and the angle α is preferably substantially equal to half of the included angle θ.

10. The heat exchanger as claimed in claim 5, wherein:

when a bending part is provided at only one side of the main body part, the spacing between flat tubes in the bending part is L, the flat tube at the bottommost edge in the bending part is shortest, the flat tube at the topmost end is longest, and the lengths of the flat tubes preferably increase incrementally by 2Ltgα from bottom to top.

11. The heat exchanger as claimed in claim 5, wherein:

when a bending part is provided on each of two sides of the main body part, the spacing between flat tubes in the bending part is L, the flat tube at the bottommost edge in the bending part is shortest, the flat tube at the topmost end is longest, and the lengths of the flat tubes preferably increase incrementally by 2Ltgα or 4Ltgα from bottom to top.

12. The heat exchanger as claimed in claim 1, wherein:

substantially no fins are provided on the heat exchange tubes at the bending points between the main body part and the bending part; preferably, an end of each heat exchange tube in the bending part is bent, such that the heat exchange tube is inserted into the slot in the manifold perpendicularly or substantially perpendicularly; preferably, the main body part of the heat exchanger is substantially rectangular, square, trapezoidal or parallelogram-shaped.

13. A heat exchange module for a heat exchange device on an air-cooled water chiller unit or commercial rooftop machine, the heat exchange device comprising at least one heat exchange module, the at least one heat exchange module having at least one trapezoidal side, wherein:

the trapezoidal side is a heat exchange side, one of the heat exchange modules is formed by fitting together two heat exchange units on left and right sides, wherein at least one heat exchange unit is the heat exchanger as claimed in claim 1.

14. The heat exchange module as claimed in claim 13, wherein:

the heat exchange module comprises two heat exchange units, the two heat exchange units being substantially identical or symmetric, and the heat exchange unit being a heat exchanger having a bending part with a trapezoidal cross section on one side only.

15. The heat exchange module as claimed in claim 13, wherein:

the heat exchange module comprises two heat exchange units, one of the two heat exchange units being a heat exchanger having a main body part only, and the other heat exchange unit being a heat exchanger having a bending part with a trapezoidal cross section on two sides.

16. A heat exchange device on an air-cooled water chiller unit or commercial rooftop machine, the heat exchange device comprising at least one heat exchange module, the at least one heat exchange module having at least one substantially trapezoidal side, wherein:

the trapezoidal side is a heat exchange side, and comprises a manifold and multiple heat exchange tubes disposed on the manifold.

17. The heat exchange device as claimed in claim 16, wherein:

one of the heat exchange modules is formed by fitting together two heat exchange units on left and right sides, wherein the trapezoidal side is formed by bending at least one of the two heat exchange units on the left and right sides; or one of the heat exchange modules is formed by a single heat exchange unit, wherein the trapezoidal side is formed by bending a part of the single heat exchange unit; or one of each of the heat exchange modules is formed by multiple heat exchange units, wherein the trapezoidal side is formed by a single heat exchange unit, the trapezoidal side being fitted onto the heat exchange module, or one of the heat exchange modules comprises one heat exchange unit and one supporting member which are fitted together facing each other, with the heat exchange unit being bent to form the trapezoidal side, and the trapezoidal side being fitted onto the supporting member.

18. The heat exchange device as claimed in claim 17, wherein:

each heat exchange unit is a single heat exchanger, the heat exchanger comprising two manifolds and multiple heat exchange tubes arranged at intervals between the manifolds, with fins preferably disposed on the heat exchange tubes.

19. The heat exchange device as claimed in claim 16, wherein:

the trapezoidal side is formed by bending at least one of two heat exchange units on left and right sides, wherein at least one of the heat exchange units is a heat exchanger.

20. A heat source unit, the heat source unit also comprising, in cooperation with each other, a heat exchange device, a blower, a water drainage plate in communication with the heat exchange device, and a machine room which houses cooling cycle constituent parts other than the heat exchange device, wherein the heat exchange device is the heat exchange device as claimed in claim 16.

* * * * *